US006152832A

United States Patent [19]

Chandler, III

[11] Patent Number: 6,152,832

[45] Date of Patent: Nov. 28, 2000

[54] GOLF PUTTER AND METHOD OF PUTTING

[75] Inventor: A. Russell Chandler, III, Atlanta, Ga.

[73] Assignee: The Whitehall Group, Ltd., Atlanta, Ga.

[21] Appl. No.: 09/057,283

[22] Filed: Apr. 8, 1998

[51] Int. Cl.[7] ..... A63B 53/00; A63B 53/14

[52] U.S. Cl. ..... 473/293; 473/300; 473/313; 473/314; 473/292

[58] Field of Search ..... 473/293, 294, 473/296, 298, 299, 300, 301, 302, 303, 313, 314, 251, 201, 204, 409, 292

[56] References Cited

U.S. PATENT DOCUMENTS

| | | |
|---|---|---|
| Re. 33,169 | 2/1990 | Leek . |
| 3,574,349 | 4/1971 | Kropp . |
| 3,679,207 | 7/1972 | Florian . |
| 3,954,265 | 5/1976 | Taylor . |
| 4,163,554 | 8/1979 | Bernhart . |
| 4,227,694 | 10/1980 | Drake . |
| 4,441,716 | 4/1984 | Chen . |
| 4,523,758 | 6/1985 | Guendling, Jr. . |
| 4,605,228 | 8/1986 | Guendling . |
| 4,621,816 | 11/1986 | Leek . |
| 4,852,879 | 8/1989 | Collins . |
| 5,078,398 | 1/1992 | Reed et al. . |
| 5,094,101 | 3/1992 | Chastonay . |
| 5,125,657 | 6/1992 | Beil . |
| 5,277,059 | 1/1994 | Chastonay . |
| 5,292,128 | 3/1994 | Solheim . |
| 5,354,060 | 10/1994 | Wooten . |
| 5,454,564 | 10/1995 | Kronogard . |
| 5,629,475 | 5/1997 | Chastonay . |

*Primary Examiner*—Sebastiano Passaniti
*Attorney, Agent, or Firm*—Needle & Rosenberg, P.C.

[57] ABSTRACT

A putter for use with a one-handed, modified, croquet-style putting stroke is described. The player is thus able to gain full advantage of his or her binocular vision because the player is able to face the target while aligning and stroking a putt. The geometry of the shaft is such that the grip is substantially centered vertically above the center of mass of the putter head when the putter is in a normal address position. The putter may include a head that allows the putter to be free standing in an address position, which assists the player in aligning a putt. The putter may also include a grip with at least one flat land and an angled bore, which provides tactile feedback to the player regarding the alignment of the putter face. The putter complies with the official rules of golf as promulgated by the United States Golf Association and the Royal & Ancient Golf Association in Great Britain. Finally, a method of using the putter is also described.

26 Claims, 5 Drawing Sheets

GOLF PUTTER AND METHOD OF PUTTING

This invention relates to a golf putter and method of putting. More particularly a putter according to the present invention is specially designed for use with a modified croquet-style of putting that most naturally conforms to a one-handed, underhanded swinging motion. The putter and method according to the present invention also fully complies with the current Rules of Golf as promulgated by the Royal and Ancient Golf Association and the United States Golf Association and are thus designed for use in tournament play.

BACKGROUND OF THE INVENTION

The putt is perhaps the single most difficult yet important shot in golf. Before a player may even stroke the ball, the player must visually examine the contour of the putting surface and judge its effect on the path of a ball rolling toward the hole from the current position of the ball. Other characteristics of the putting surface or other factors can also have a significant effect on the path of a putt already stroked and rolling toward the hole. The direction in which the grass generally grows, the length of the grass on the putting surface, the type of grass on the putting surface, moisture on the putting surface, imperfections in the putting surface like footprints, spike marks or ball marks carelessly repaired, wind and a golf ball in which the center of mass and geometric center do not coincide are just some of the factors that affect the path of a rolling putt and, to some degree, for which the player must account. After examining the putting surface between the ball and the hole and accounting for other factors, the player must then execute a stroke that causes the ball to roll in a precise initial direction and with the precise speed required so that the ball's path intersects the hole and with speed slow enough for the ball to fall into the hole. Because of its complexity, nuance and potential for randomness, putting a ball into the hole is the most difficult and most precise task in golf. Yet, a putt is the single type of stroke that is most often required during a round of golf. To complicate matters further, the player's visual perception of the target is skewed which leads to errors in alignment because the player does not face the target while addressing the ball or stroking a putt. Instead, the player views the target while looking laterally down the intended target line. This sub-optimal visual perspective causes visual distortion that interferes with the player's ability to align the putting stroke with the target line that was chosen while standing behind the ball and looking toward the hole in order to determine the intended target line. This visual effect is detailed in a book entitled "See It & Sink It—Mastering Putting Through Peek Visual Performance" by Dr. Craig L. Farnsworth.

Golf courses are designed and standards for scoring are set based on the assumption that a player will be able to hit the ball onto the putting surface in two strokes less than par for each hole. Once on the ball is on the putting surface, the player is allowed two putts to stroke the ball into the hole in order to play the hole at par. Thus, an 18-hole golf course is designed to allow 36 putts in a round of golf played at par. Most, though not all, 18-hole golf courses play to a par of 72, which means that putting constitutes approximately 50% of the strokes prescribed for a round of golf.

The importance of putting in golf is illustrated by the professional careers of many notable players. Sam Snead, the winner of more officially sanctioned professional tour events than any other player, is a notable example of an extraordinary player who struggled with his putting stroke late in his career. In an attempt to cure his wavering putting stroke, Sam Snead adopted a croquet-style putting stroke in which he straddled the target line of his putt, drew his putter back between his legs and struck the ball with a pendulum-like swing along the target line. His croquet-style putting stroke worked relatively effectively for him until the Royal & Ancient Golf Association and the United States Golf Association (the "USGA") changed the Rules of Golf ("the Rules") to make his stroke illegal.

The Rules allow a player to use a modified croquet-style stoke in which the player stands with both feet on one side of the target line and faces the target. This type of stroke is thought by some, including the inventor, to be more effective for a number reasons. For example, the player may simultaneously address the putt and execute the stroke from a position that permits both eyes to focus on the target.

The Rules were also changed to make it more difficult to design a putter that would be useful for making such a stroke. The Rules allow the shaft of a putter to be connected to any point on the putter head and to have bent and straight portions, with the bent portion having a length measured along its axis less than or equal to 5 inches. The Rules also require that the projection of the straight portion of a putter shaft onto a plane perpendicular to the target line diverge at least 10° from vertical. Additionally, the overall length of the shaft, measured along a straight-line extension of the straight portion of the shaft to the ground when the putter is grounded, must be greater than or equal to 18 inches.

When using a traditional putting stroke, a player faces a direction generally perpendicular to the target line and thus must turn to look down the target line when preparing to stroke the ball. This creates a visual distortion that interferes with the player's ability to perceive accurately the location of the target. Because of this effect, most right-handed players perceive that the target is farther right than its actual location. Additionally, the player loses depth perception in viewing the target in such a manner because the effective distance between the players eyes (in a direction perpendicular to a line from the eyes to the target) is small when viewing the target from such a traditional stance.

Aside from the disadvantages in viewing the target and determining the proper line and distance to the target stemming from the use of the traditional putting stance, this stance also interferes with the mechanics of putting. Specifically, the primary axis around which the putter swings during a traditional putting stroke is defined by the player's spine. When taking a traditional stance and swinging a putter from such a stance, the player swings the shoulders in such a manner that the putter rotates around the spine. Assuming a fixed relationship between the player's hands and spine, the resulting stroke follows an arc that moves inside the target line on the back swing, to the target line at impact (at least if performed properly), and back inside the target line after impact. When traveling along such an arc (and still assuming the fixed spatial relationship between the hands and the spine), the face of the putter also rotates relative to the target line during the stroke. On the back swing, the putter face opens to the target line, at impact the putter face is perpendicular to the target line (again if the stroke has been properly executed), and the putter face closes to the target line after impact.

A noted contemporary instructor on putting, Dave Pelz has studied the effects of misalignment relative to the target line (when the putter strikes the ball) of (1) the putter's swing path, (2) the putter face and (3) the optimum hitting location on the putter face on the ultimate putting success.

Mr. Pelz has found that all three types of misalignment cause significant error in the putting stroke and thus decrease the chances of the ball going into the hole. However, he opines that misalignment of the putter face causes the largest deviation from the player's intended path of any particular putt. In order to reduce the possibility of misalignment of the putter face, path and hitting location, Mr. Pelz recommends that the player's putting stroke start with the optimum hitting location on the putter face immediately adjacent to the ball and that the stroke travel along a path aligned with the target line with the face remaining perpendicular to the target line for the entire stroke. However, as explained above, when a player swings the putter around the spine only, such a stroke does not result. In fact, the putter path corresponds to the target line at only one point in its arc and the face is perpendicular to the target line at only one point in its arc—and these two points do not necessarily coincide. Thus, to execute a stroke with a path along the target line and with a square putter face while using a traditional putting stance and stroke requires a complex combination of multi-axis rotational movements. Executing such a multi-axis stroke in a manner that accomplishes the primary and complex task of causing a ball to roll smoothly along a precise path at a precise speed renders the most difficult and important stroke in golf even more difficult. Some of the most common practice aids and drills in golf are designed purely to enable players to ingrain this complex, multi-axis putting stroke into their muscle memory. Other players simply concentrate on swinging the putter around only their spine and training themselves to hit the ball at the precise moment in time when the putter path, face and hitting location are correctly aligned with the target line. Thus, both widely adopted approaches to executing the traditional putting stroke suffer from disadvantages that interfere with the ultimate goal—putting the ball into the hole.

The only way in which to avoid the disadvantages associated with the traditional putting stroke is to swing the putter head around a horizontal axis of rotation that is perpendicular to the target line—exactly the result of Sam Snead's outlawed croquet-style stroke. It is possible, however, to design a putter within the Rules that allows the player to swing the putter on an arc defined by rotation around a horizontal axis that is perpendicular to the target line, or at least on an arc close to this optimum arc. The resulting putting stroke is executed while the player stands generally facing the target with both feet on one side of the target line. Numerous putters have been designed to allow a player to take such a stance and execute such a stroke, but always with some type of requirement to manipulate the club in a secondary manner not associated with purely swinging the putter around a horizontal axis perpendicular to the target line. Each of the following U.S. Patents describe a putter for use with modified croquet-style stance and stroke as described above, but they all have characteristics that interfere with the natural pendulum action of the putting stroke, or do not comply with the Rules.

| U.S. Pat. No. | Patentee(s) | Issue Date |
|---|---|---|
| 3,574,349 | Kropp | 4/13/71 |
| 4,163,554 | Bernhart | 8/7/79 |
| 3,679,207 | Florian | 7/25/72 |
| 4,227,694 | Drake | 10/14/80 |
| 4,523,758 | Guendling, Jr. | 6/18/85 |

-continued

| U.S. Pat. No. | Patentee(s) | Issue Date |
|---|---|---|
| 5,125,657 | Beil | 6/30/92 |
| Re. 33,169 | Leek | 2/20/90 |

Kropp, for example describes a putter suitable for use with a two-handed stroke in which the upper end of the grip lies vertically above the heel rather than the center of the face. Thus, if a player were to grasp Kropp's putter with one hand on the upper end of the grip, the natural tendency of the putter would be to hang such that a line from the upper end of the grip to the center of the face is angled toward the player when viewed from the front at address. Any attempt to use Kropp's putter in a one-handed putting stroke would likely result in the player striking the ball away from the center of the face. Bernhart and Florian describe putters that are similarly configured to Kropp's putter, but having a top end of the grip that is even more misaligned with the center of the face.

Guendling, Jr. describes a putter designed for use with a one-handed stroke in which the upper end of the grip does lie vertically above the center of the face when used in a stroke as is evident from Guendling Jr.'s FIG. 3. However, Guendling, Jr.'s putter does not comply with the Rules because the angle between the axis of the straight portion of the shaft of the putter in its normal address position and vertical is less than 10° (it is actually 0°). Leek, Drake and Beil describe putters that similarly do not comply with the Rules. Additionally, the Guendling, Jr. putter is shown to be of 10–26 inches in length, which violates the Rules requirement that the putter shaft be at least 18 inches long as measured from the top of the grip along the axis of the shaft or a straight-line extension of the shaft to the sole of the club.

Thus, a need continues to exist for a putter suitable for use with a modified croquet-style stroke that complies with the Rules and facilitates a natural, pendulum-type swinging stroke with little or no extraneous manipulation of the putter when making a stroke.

SUMMARY OF THE INVENTION

The putter and method according to the present invention improves upon prior art devices and methods by employing a putter having a grip for which the effective center of the grip is located substantially vertically above the center of the face of the putter at address while simultaneously being suitable for play as permitted under the Rules.

A golf putter according to the present invention is adapted for use with a one-handed, modified croquet-style putting stroke. Like all putters, a putter according to the invention includes a head, and the head defines a center of mass. The face of the putter also defines a face angle line that lies on the face and is generally horizontal when the putter is in a normal address position. Also like all putters conforming to the Rules, a shaft extends from the head of the putter of the invention. A connector portion of a shaft is attached to the head and may be attached at any point on the head. At least a portion of the shaft is straight, and the straight portion extends from the connector portion to a free end on which the grip is mounted.

When stroking a putt, the player grasps the grip and the putter is balanced such that the center of the putter face naturally hangs substantially directly below the player's shoulder joint. This balance, along with the one-handed stroke, allows the player to swing the putter around only one pivot point, his or her shoulder joint, in a single plane that contains the intended target line. Additionally, the player's arm hangs in an anatomically neutral position—virtually the same position in which the arm hangs while standing in a relaxed state. When swinging the putter, the player swings his or her arm in a natural manner similar to the manner in which the arms swing while walking. This type of pendulum motion within a plane containing the target line maximizes the chances that the putter face will be aligned perfectly with the target line at impact. The lack of manipulation required by the player to keep the putter face square at impact (or artificially to keep the putter head traveling within a plane containing the target line) permits a smoother, rhythmic, more athletic stroke that is free of the muscle tension inherent in a normal stroke, which can interfere with the player's feel and thus distance control. To aid in the alignment of the putter face during a stroke, the grip is constructed of rubber, synthetic rubber or any other suitably compliant material typically used for golf club grips. The grip also preferably includes at least one flattened portion that provides tactile feedback to the player regarding the alignment of the face. The grip may also include other flattened portions to provide further tactile feedback regarding face alignment.

The grip further includes a bore that is offset at an angle such that the longitudinal axis of the grip is substantially vertical when the putter is in a normal address position. This offset bore enhances the effectiveness of the putter because it provides yet another tactile reference for the player, a grip that is in alignment with the plane in which the putter head swings and with the vertical plane containing the intended target line.

It is accordingly an object of the present invention to provide a putter for use with a one-handed, modified, croquet-style putting stroke that is substantially self aligning because it is balanced such that the center of mass of the putter swings naturally, and with little or no manipulation by the player, and directly from the player's shoulder joint, thus enabling a smooth putting stroke substantially within a vertical plane containing the intended target line.

It is a further object of the present invention to provide the player optimal sight alignment by allowing the player to look directly behind and along the intended target line of a putt, thus eliminating the visual distortion resulting from standing in a traditional putting stance and looking laterally down the target line.

It is a further object of the present invention to provide a putter that can stand on its own in a normal address position so that the player may examine the alignment of the putter from behind the putter along the target line.

It is a still further object of the present invention to provide a putter with a grip having one or more flattened portions that facilitate alignment of the putter face by providing real time tactile feedback to the player about the face alignment.

It is a still further object of the present invention to provide a putter with a grip having an offset bore such that the longitudinal axis of the grip remains in the vertical plane containing the intended target line as the player swings the putter.

It is a still further object of the present invention to provide a method of putting that enables a player to obtain the full advantange of his or her binocular vision while aligning a putt and executing a putting stroke.

It is a still further object of the present invention to provide a method of putting that enables a player to swing a putter exclusively from the shoulder joint so that the putter head remains square to and directly over the target line throughout the entire stroke.

It is a still further object of the present invention to provide a method of putting that enables a player to use effectively the small muscles in the hand and wrist in a putting stroke in order to gain the benefits of the fine motor control inherent in those muscles.

Other objects, features and advantages of the present invention will become apparent with reference to the remainder of this document.

DETAILED DESCRIPTION OF THE INVENTION

Figure 1:
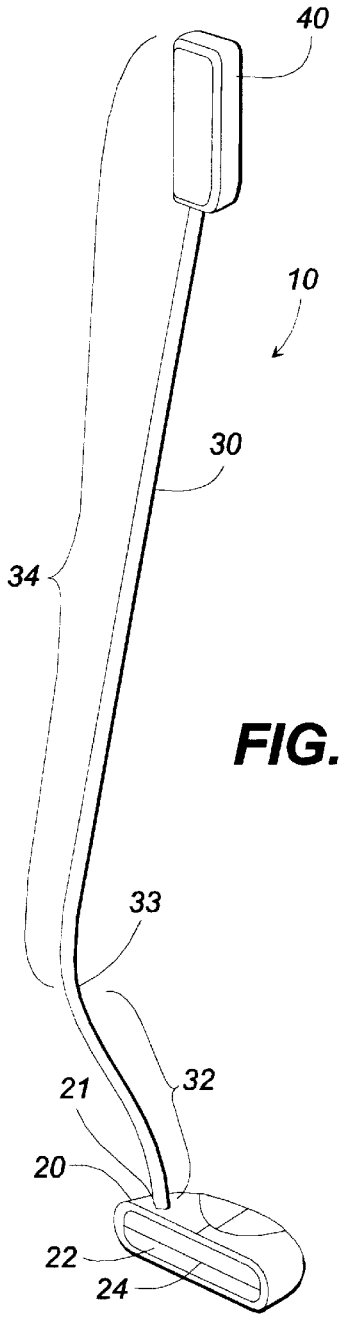
FIG. 1 is a perspective view of the putter from the front illustrating the overall configuration of one embodiment of a putter according to the present invention.

FIG. 1 is a perspective view of the putter from the front illustrating the overall configuration of one embodiment of a putter according to the present invention. A connector portion 32 of shaft 30 extends from point 21 located anywhere on putter head 20, and straight portion 34 extends from point 33 on connector portion 32 to a free end of shaft 30. The connector portion may be of any acceptable configuration including, for example, (1) a curved portion integrally formed with the straight portion 34 as shown, (2) a separate component, (3) an integrally formed part of the head, or (4) a second straight portion of the shaft at a different angular orientation from straight portion 34. Grip 40 is mounted on the free end of straight portion 34 of shaft 30 and is configured such that the player may comfortably hold, position and swing the putter head while stroking a putt. Putter head 20 shown in FIG. 1 and in all other figures is of a mallet design that is weighted more heavily in its sole and on its lateral portions. Such a putter head, along with other suitable designs, offers the advantage that putter 10 is free standing. Thus, a player may place putter 10 on the intended target line in its normal address position, let it go, and examine the alignment of putter head 20 and thus face 22 with target line 50 before regrasping grip 40 and stroking a putt. While the illustrated mallet putter head design is well suited for use in a putter according to the invention, its depiction in the figures does not exclude the use of other putter head designs in a putter according to the invention.

A player uses putter 10 to hit the ball with a one-handed, modified croquet-style putting stroke. Like all putter heads, head 20 has a center of mass ($C_{g,\ head}$). The face 22 of putter head 20 also defines a face angle line 24 that lies on the face and is generally horizontal when the putter is in a normal address position. Also, like all putters conforming to the Rules, a shaft 30 extends from the putter head 20. A connector portion 32 of shaft 30 is attached to the putter head 20 at point 21, which may be any point on putter head 20. At least a portion of shaft 30 is straight, and straight portion 34 extends from point 33 on connector portion 32.

An alternative embodiment of putter 10, not shown, has a shaft with no curved or angled connector portion. In such an embodiment, the straight portion of the shaft is connected directly to the putter head. Such an arrangement is only possible when the point at which the shaft is connected to the head is located far enough away from the geometric center of the putter head to allow the grip to be appropriately located above the geometric center of the putter head while simultaneously complying with the Rules.

Figure 2:
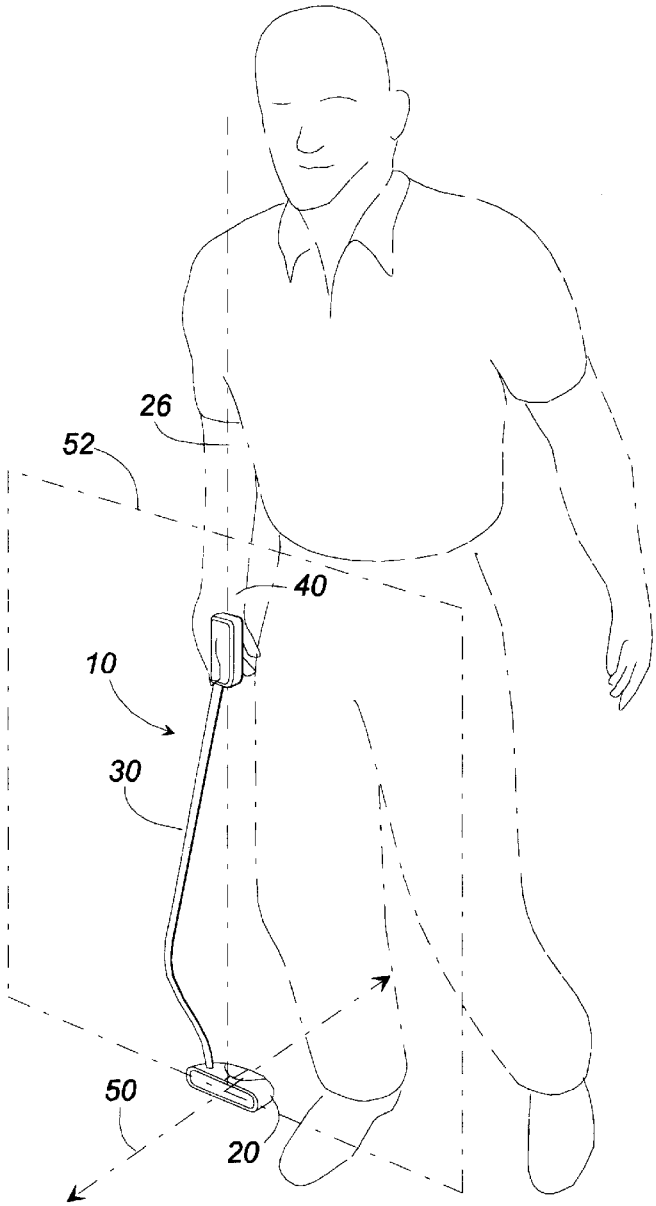
FIG. 2 is a perspective view of the putter of FIG. 1 illustrating the relationship among the putter head, the grip and the player's shoulder joint when the putter and player are in a normal address position.

FIG. 2 is a perspective view of the putter of FIG. 1 illustrating the relationship among putter head 20, grip 40, the player's shoulder joint and the player's arm when putter 10 and a player are in a normal address position. Also shown in FIG. 2 is vertical plane 52, which contains face angle line 24 (shown in FIG. 1) and is perpendicular to intended target line 50. Plane 52 is the plane onto which straight portion 34 (shown in FIG. 1) is projected in determining whether shaft 30 complies with the Rules. The way in which plane 52 is used in determining compliance with the Rules is explained more fully below in connection with FIG. 16.

FIG. 2 also discloses a player in a normal address position, holding putter 10 with his or her dominant hand and preparing to stroke a putt along an intended target line 50. FIG. 2 further discloses a player in a normal address position, holding putter 10 with his dominant hand with the arm substantially fully extended. The vertical alignment of putter head 20, grip 40, the player's arm and shoulder joint are apparent. As can be seen, the player stands beside the intended target line 50 and facing the intended target. This allows the player to look directly behind and along the intended target line 50 of a putt while aligning and while stroking the putt. Thus, a player may obtain the full advantage of his or her binocular vision throughout the putting process. This is a particularly important feature of putter 10 because it substantially removes the single obstacle to proper alignment that cannot be perceived by a typical player directly. That is, when using a traditional putter, a player must compensate for the visual distortion caused by viewing the target laterally (and only during a putting stroke and not during the alignment process) by watching how and where the ball rolls after it is struck. The difficulty with this type of feedback is that the player cannot distinguish the error caused by visual distortion from the error caused by other factors (e.g., a poorly struck putt or a poorly chosen intended target line).

When stroking a putt with putter 10 in a manner most suited to take advantage of the design of putter 10, the player swings putter 10 completely within a substantially vertical plane containing the intended target line 50. Additionally, the player should keep face angle line 24 perpendicular to target line 50 throughout the stroke. As explained more fully below, grip 40 is particularly suited to aid the player in keeping face angle line 24 perpendicular to target line 50 throughout the stroke (i.e., in keeping the face square to the target throughout the stroke). When stroking long putts, the player may keep his or her wrist relatively stiff such that the putter head 20 swings from a pivot point at the player's shoulder joint, such as the natural movement of the normal arm swing when one walks. The movement of putter 10 using this stiff-wristed stroke is accomplished using the relatively large muscle groups that move a player's entire arm from the shoulder joint. When stroking short putts, a player may desire to use a wrist-actuated stroke in which putter head 20 rotates around a pivot point at the player's wrist rather than the shoulder joint. Such a stroke is performed using the small muscle groups of the hand and wrist and may provide more "feel" and fine control than the stiff-wristed, shoulder-based stroke described immediately above. The key with both strokes, however, is in keeping putter head 20 moving along target line 50 with face angle line 24 perpendicular to target line 50 throughout the stroke. Ultimately, whether a particular player prefers the wrist-based stroke, shoulder-based stroke, or a combination of the two in a particular set of circumstances is a matter of personal preference.

Figure 3:
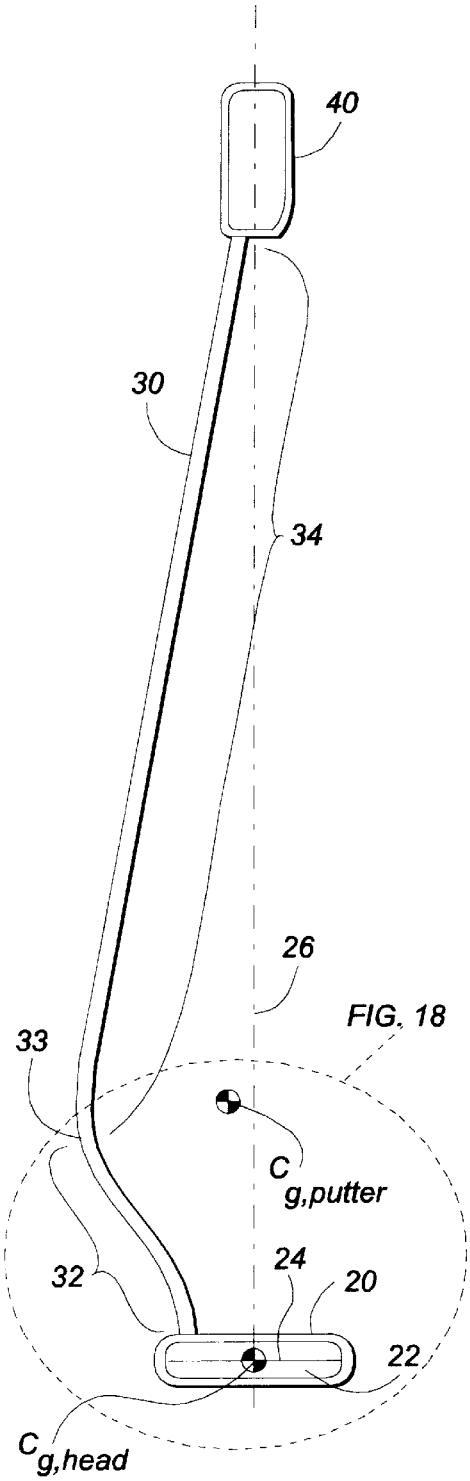
FIG. 3 is front elevational view illustrating the putter of FIG. 1 and the substantially vertical alignment of the center of mass of the putter head and putter as a whole with the grip when the putter is in a normal address position.

FIG. 3 is front elevational view illustrating the putter of FIG. 1 and the substantially vertical alignment of the center of mass of putter head 20 ($C_{g,\ head}$) and grip 40 when putter 10 is in a normal address position. It should also be noted that the center of mass of the entire putter ($C_{g,\ putter}$) is also approximately vertically aligned with grip 40. When viewed from the front, as illustrated in FIG. 3, face angle line 24 and vertical line 26 intersect substantially directly in front of $C_{g,\ head}$. Typically, $C_{g,\ head}$ substantially coincides with the geometric center of face 22 of putter head 20 when a putter head is viewed from the perspective shown in FIG. 3. Because shaft 30 is not symmetric about vertical line 26, the weight of shaft 30 will cause $C_{g,\ putter}$ to be located slightly leftward and higher than $C_{g,\ head}$ (from the perspective shown in FIG. 3). As described more fully below in connection with FIG. 18, putter head 20 can be designed so that $C_{g,\ putter}$ is substantially vertically aligned with the geometric center of face 22 of putter head 20. This would be accomplished by concentrating weight on the right side and bottom of putter head 20.

Figure 4:
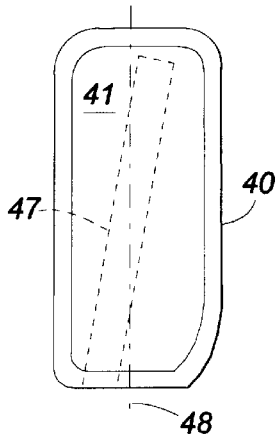
FIG. 4 is a front elevational view of an embodiment of a grip suitable for use with the putter of FIG. 1.
Figure 5:
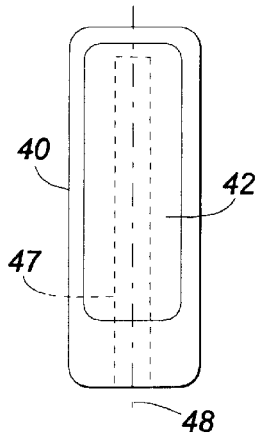
FIG. 5 is a right side elevational view of the grip shown in FIG. 4.

FIGS. 4–9 are the six normal views of one embodiment of a grip suitable for use with a putter according to the present invention. Grip 40 may be described generally as a block of resilient material with substantially flat lands 41–46 respectively on each of six sides. The corners and edges at which lands 41–46 meet are appropriately rounded for the player's comfort. Grip 40 is made of rubber, synthetic rubber, or any of the materials of which conventional golf grips are made. FIG. 4 is a front elevational view of an embodiment of a grip suitable for use with the putter of FIG. 1. The lower right corner of grip 40 as seen in FIG. 4 is rounded with a relatively large radius to form a comfortable resting place for the player's thumb, for example, when the player holds grip 40 such that the posterior side of the player's hand faces the target. Of course, a player may choose to hold grip 40 in a different manner, and grip 40 as shown has been found to be compatible with virtually any type of hold chosen by a player. Bore 47 through grip 40 is angled relative to lands 42 and 45. The angular offset of bore 47 compensates for the angle of straight portion 34 of shaft 30 from vertical when putter 10 is in a normal address position. The angular offset of bore 47 thus enables a player naturally and comfortably to grasp putter 10 in its normal address position with the $C_{g,\ head}$ and/or $C_{g,\ putter}$ substantially vertically aligned with longitudinal axis 48 of grip 40.

Figure 6:
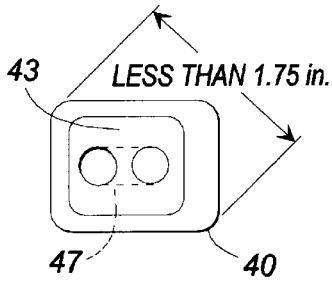
FIG. 6 is a bottom plan view of the grip shown in FIG. 4.
Figure 7:
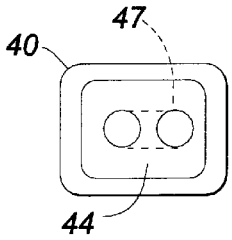
FIG. 7 is a top plan view of the grip shown in FIG. 4.
Figure 8:
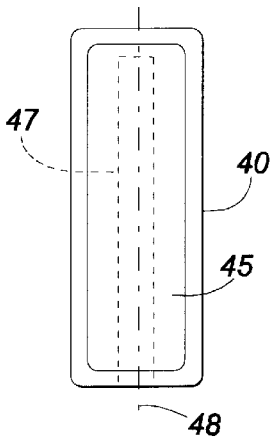
FIG. 8 is a left side elevational view of the grip shown in FIG. 4.
Figure 9:
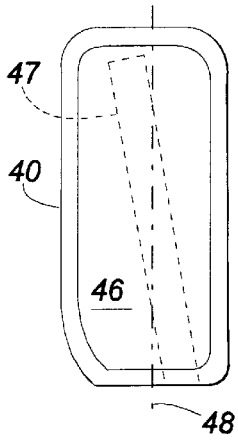
FIG. 9 is a back elevational view of the grip shown in FIG. 4.
Figure 10:
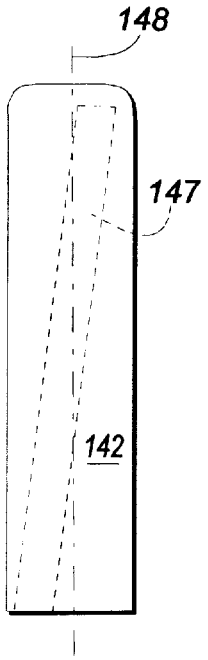
FIG. 10 is a front elevational view of a second embodiment of a grip suitable for use with the putter of FIG. 1.
Figure 11:
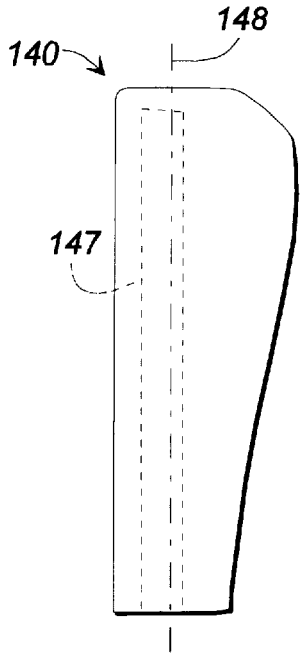
FIG. 11 is a right side elevational view of the grip shown in FIG. 10.
Figure 12:
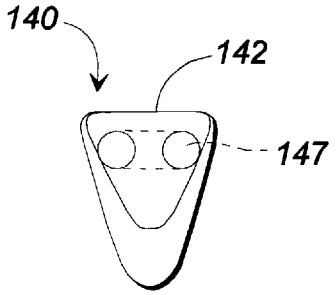
FIG. 12 is a bottom plan view of the grip shown in FIG. 10.
Figure 13:
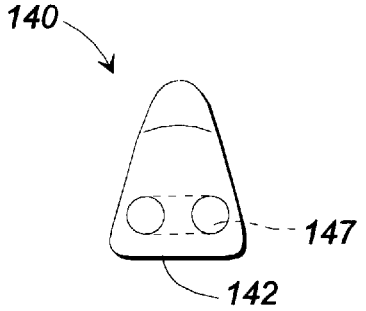
FIG. 13 is a top plan view of the grip shown in FIG. 10.
Figure 14:
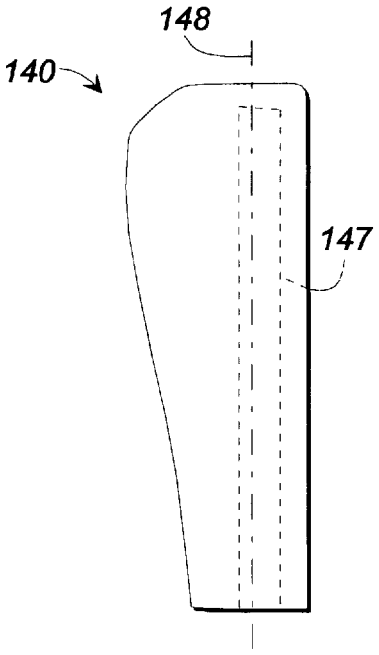
FIG. 14 is a left side elevational view of the grip shown in FIG. 10.
Figure 15:
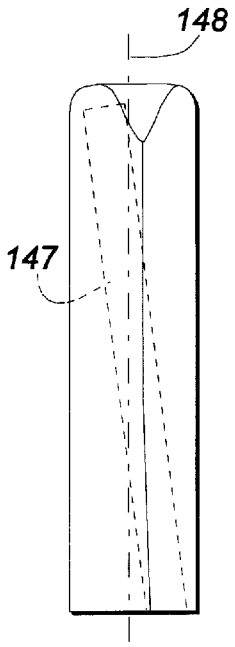
FIG. 15 is a back elevational view of the grip shown in FIG. 10.

The angular offset of bore 47 ensures that lands 41–46 define planes that are preferably either parallel or perpendicular to face angle line 24 so that lands 41–46 provide a tactile reference for the player of the alignment of putter face 22. That is, the player can feel how putter face 22 is aligned by how lands 41–46 of grip 40 feel within his or her grasp. FIG. 6 is a bottom plan view of the grip shown in FIG. 4 in which the maximum cross-sectional width of grip 40 is apparent. In order to comply with the Rules, this maximum cross-sectional width dimension must be no greater than 1.75 inches.

FIGS. 10–15 are the six normal views of a second embodiment of a grip suitable for use with a putter according to the present invention FIG. 1. Grip 140 shown in FIGS. 10–15 has an approximately triangular cross section and one substantially flat land 142 that is substantially perpendicular to target line 50 when putter 10 is in a normal address position. Grip 140 has an offset bore 147 to reorient grip 140 with respect to straight portion 34 of shaft 30. Preferably, the longitudinal axis 148 of grip 140 is substantially vertical when putter 10 is in a normal address position. The particular shape of grip 140 has been found to be a more anatomically compatible shape than grip 40, but grip 140 provides most, if not all, the advantages of grip 40.

Figure 16:
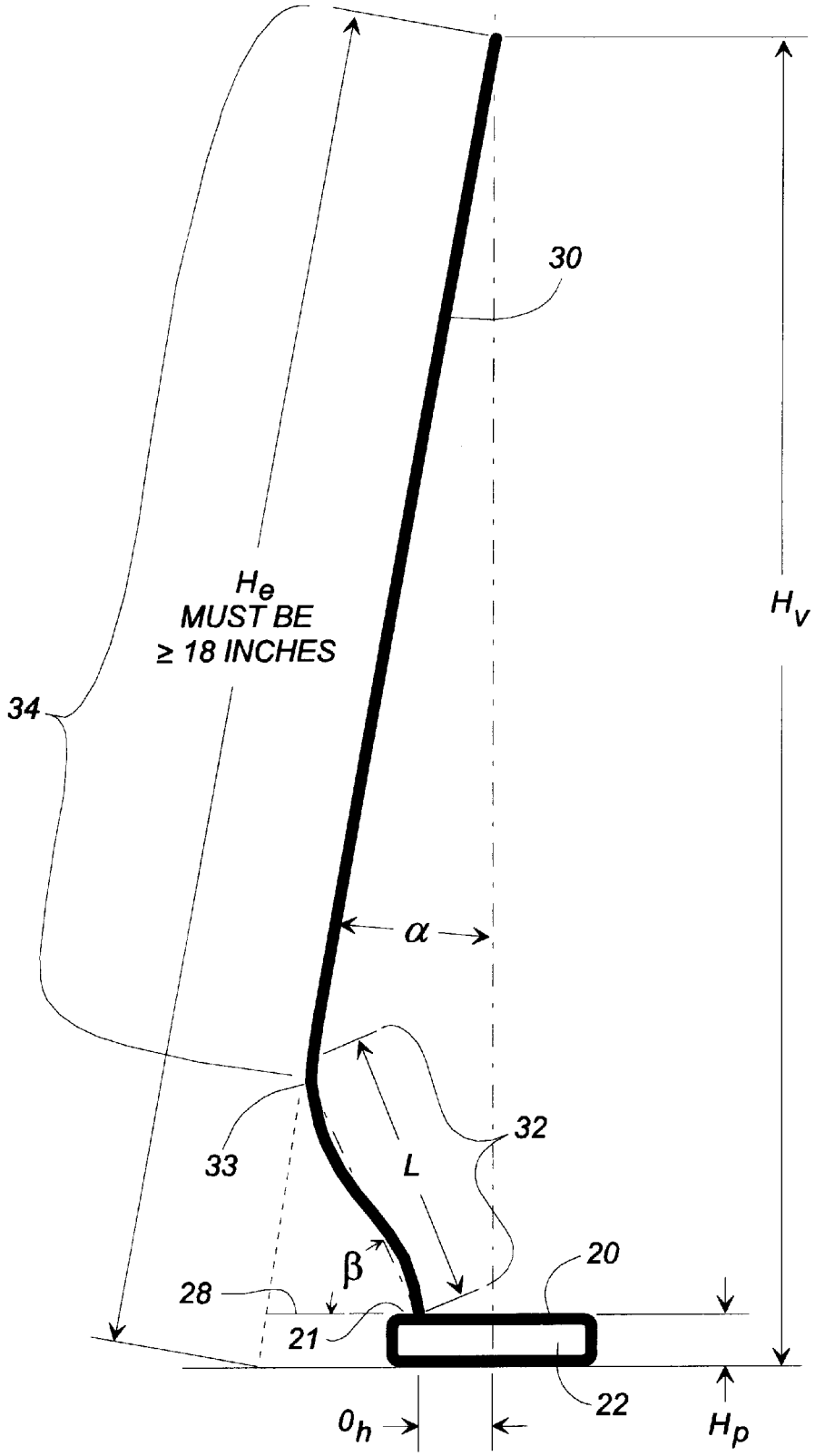
FIG. 16 is a schematic view of a putter according to the present invention illustrating the geometry of the putter.

FIG. 16 is a schematic view of a putter according to the present invention illustrating the geometry of the putter. While the schematic illustration provides a description of the geometry of a putter in a two-dimensional space, one of skill will understand that putters are three-dimensional articles. Thus, FIG. 16 and the accompanying discussion below are not meant to limit the putter of the present invention to one in which the geometry is limited to the two-dimensional relationships among the shaft, putter head and grip shown and discussed in connection with FIG. 16.

In particular, FIG. 16 illustrates the angle ($\alpha$) between the straight portion 34, when projected onto a plane parallel to face angle line 24, and vertical line 26 when putter 10 is in a normal address position (the orientation shown). Connector portion 32 defines a straight line distance, L, from point 21 (at which connector portion 32 connects to putter head 20) to point 33 (at which connector portion 32 meets straight portion 34 ). The line from point 21 to point 33 forms an angle ($\beta$) with horizontal line 28. Distance $H_v$, is defined as the vertical height of putter 10 from the top of straight portion 34 to the ground when the putter is in a normal address position. Distance $H_p$ is the height of putter head 20 from the ground to point 21. Distance $O_h$ is the horizontal distance, measured when putter 10 is in a normal address position, between the geometric center of face 22 to point 21. Distance $H_e$ is the effective height of putter 10 (and is the dimension used to determine compliance with the Rules) and is measured along a projection of straight portion 34 to its intersection with the ground when the putter is in a normal address position.

The equation defining $H_e$ in terms of $\alpha$, $\beta$, $H_p$, L, and $O_h$ (as those terms are shown and described in connection with FIG. 16) is:

$$H_e = \frac{1}{\cos\alpha}\left\{H_p + \frac{L[\cos(\beta-\alpha)]}{\sin\alpha} + \frac{O_h}{\tan\alpha}\right\}$$

As already mentioned above, this equation and analysis assumes that points 33 and 21 are located in the same vertical plane onto which straight portion 34 is projected in order to determine angle $\alpha$. If, for example point 21 were in this plane and point 33 were "behind" that plane (when putter 10 is in a normal address position and putter 10 is viewed from the front), then the projection of L onto the same plane onto which the straight portion 34 is projected would be necessary to find an adjusted value for L to be used in the equation above (this adjusted value for L would be less than the actual value L). For simplicity, L is assumed to be defined by points 21 and 33 that are located within the vertical projection plane. However, this simplifying assumption about the location of points 21 and 33 does not limit the scope of the invention. For example, point 33 could be located forward (i.e., toward the target at address) or aft of the vertical plane 52 (shown in FIG. 2).

In order to comply with the Rules, angle $\alpha$ must be at least 10°. The Rules also require that, the length of connector portion 32 ($L_{connector}$) must be no greater than 5 inches (as measured along the axis of connector portion 32 from point 33 through point 21 to the closest point on the sole of putter head 20). Because connector portion 32 may be curved and a curved path between two points is longer than a straight line, L as defined above is less than $L_{connector}$ in all cases except when connector portion 32 is a straight section and point 21 is located on the sole of putter head 20 (i.e., when $H_p$=0). Under the Rules, $H_e$ must be no less than 18 inches. However, in order to allow a player to use a putter comfortably, $H_e$ is typically about 27 inches.

For putter 10 according to the present invention, $H_e$ is maximized when $\alpha$ and $\beta$ are exactly 10°. However, the value of $\alpha$ has a much more significant effect upon $H_e$ than $\beta$. For example, values of up to 60° for $\beta$ are possible while maintaining a value of $H_e$ of about 30 inches. By contrast, increasing $\alpha$ from 10° to only 15°, while holding other parameters constant, can cause $H_e$ to shrink by about 12 inches. Thus, angle $\alpha$ is preferably exactly 10° or only slightly larger. Of course, variations in the geometry of shaft 30 and putter head 20 are possible within the scope of the present invention. For illustration purposes only, the table below depicts the manner in which $H_e$ varies for certain values of $\alpha$, $\beta$, L, $H_p$, and $O_h$. The values shown in the table are not meant to limit in any way the range of acceptable values for any of the parameters included.

| Effective Height ($H_e$) (in.) | Horizontal Offset ($O_h$) (in.) | Putter Height ($H_p$) (in.) | Shaft Angle (α) (degrees) | Effective Connector Length (L) (in.) | Connector Angle (β) (degrees) |
|---|---|---|---|---|---|
| 25.6 | 0.0 | 0.75 | 10 | 4.25 | 10 |
| 28.5 | 0.5 | 0.75 | 10 | 4.25 | 10 |
| 31.4 | 1.0 | 0.75 | 10 | 4.25 | 10 |
| 34.3 | 1.5 | 0.75 | 10 | 4.25 | 10 |
| 37.1 | 2 | 0.75 | 10 | 4.25 | 10 |
| 33.9 | 2 | 0.75 | 11 | 4.25 | 11 |
| 31.3 | 2 | 0.75 | 12 | 4.25 | 12 |
| 29.1 | 2 | 0.75 | 13 | 4.25 | 13 |
| 27.1 | 2 | 0.75 | 14 | 4.25 | 14 |
| 25.5 | 2 | 0.75 | 15 | 4.25 | 15 |
| 24.1 | 2 | 0.75 | 16 | 4.25 | 16 |
| 22.8 | 2 | 0.75 | 17 | 4.25 | 17 |
| 21.7 | 2 | 0.75 | 18 | 4.25 | 18 |
| 37.1 | 2 | 0.75 | 10 | 4.25 | 10 |
| 34.2 | 2 | 0.75 | 10 | 3.75 | 10 |
| 31.3 | 2 | 0.75 | 10 | 3.25 | 10 |
| 28.4 | 2 | 0.75 | 10 | 2.75 | 10 |
| 25.4 | 2 | 0.75 | 10 | 2.25 | 10 |
| 22.5 | 2 | 0.75 | 10 | 1.75 | 10 |
| 19.6 | 2 | 0.75 | 10 | 1.25 | 10 |
| 33.9 | 1.5 | 0.75 | 10 | 4.25 | 0 |
| 34.3 | 1.5 | 0.75 | 10 | 4.25 | 10 |
| 33.9 | 1.5 | 0.75 | 10 | 4.25 | 20 |
| 32.8 | 1.5 | 0.75 | 10 | 4.25 | 30 |
| 30.9 | 1.5 | 0.75 | 10 | 4.25 | 40 |
| 28.4 | 1.5 | 0.75 | 10 | 4.25 | 50 |
| 25.4 | 1.5 | 0.75 | 10 | 4.25 | 60 |
| 21.8 | 1.5 | 0.75 | 10 | 4.25 | 70 |
| 17.9 | 1.5 | 0.75 | 10 | 4.25 | 80 |

Figure 17:
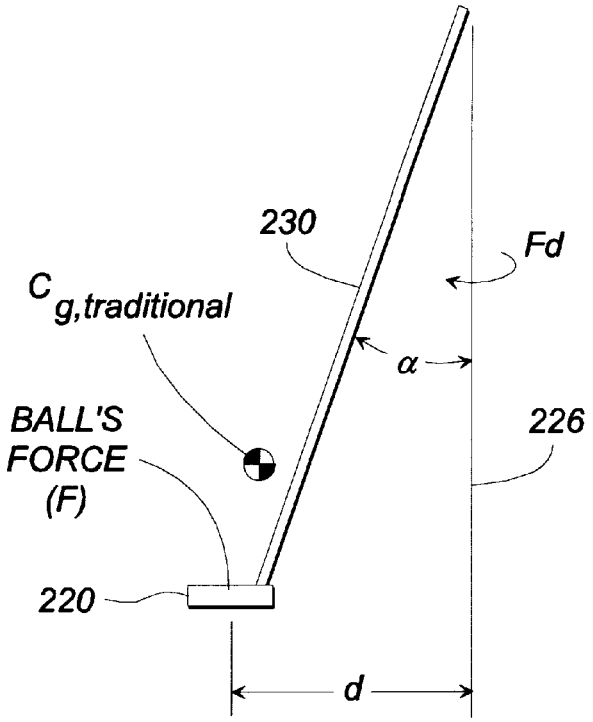
FIG. 17 is a schematic view of a traditional putter illustrating the twisting moment induced by the horizontal distance between the striking area of the face of the putter and the grip.

FIG. 17 is a schematic view of a traditional putter illustrating the twisting moment induced by the horizontal distance between the striking area of the face of the putter and the grip. Putter head 220 is shown attached to shaft 230 in a traditional manner with shaft 230 attached to putter head 220 at the heel of head 220. Because of angle α, the free end of shaft 230 where a grip would be mounted is located a horizontal distance d from the free end of shaft 230, which is measured from the point where a ball normally would strike head 220 to line 226 (extending vertically downward from the free end of shaft 230). When a ball strikes the face of head 220 at the indicated location with a force F, a moment equal in magnitude to the product Fd is generated. In order to keep the face of putter head 220 square to the intended target line, a player using a traditional putter must counteract moment Fd by applying a moment of equal magnitude but in the opposite direction.

A similar moment is generated when a player swings the putter and accelerates putter head 220. The magnitude of this acceleration-induced moment is equal to the product of the mass of the entire putter, the acceleration of the putter's center of mass ($C_{g,\ traditional}$) and the distance from $C_{g,\ traditional}$ to line 226. When, for example, the putter head 220 is accelerated toward the target, the induced moment is in the same direction as that shown as Fd in FIG. 17. Thus, the player must resist and compensate for two twisting moments when swinging a traditional putter and striking a ball. One moment is induced by acceleration and the center of mass of the putter being located at a horizontal distance from line 226. The other moment is induced by the force imparted on the putter face when the face strikes the ball at a point which is horizontally distant from line 226. The resistance to and compensation for these twisting moments interfere with the player's ability to develop a consistent feel and stroke. In essence, these twisting moments interfere with the player's ability to putt consistently and they needlessly add variables to an already complex physical task—a putting stroke.

Figure 18:
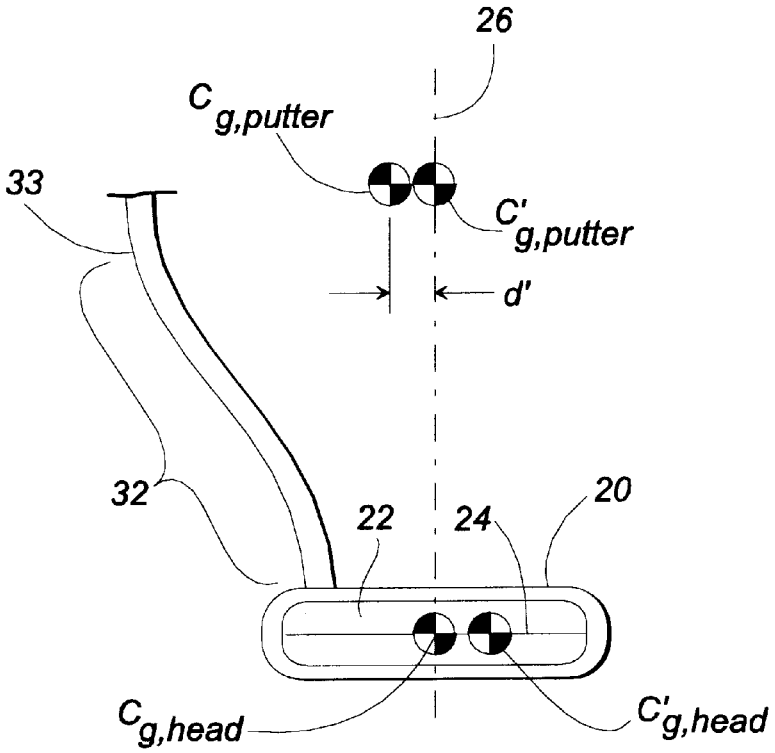
FIG. 18 is an exploded front elevational view of the face of the putter shown in FIG. 3 illustrating the manner in which the center of mass of the putter head can be positioned such that the center of mass of the putter as a whole is positioned directly below the grip and above the geometric center of the face of the putter.

FIG. 18 is an exploded front elevational view of the face of the putter shown in FIG. 3 illustrating the manner in which the center of mass of the putter head can be positioned such that the center of mass of the putter as a whole is positioned directly below the grip and above the geometric center of the face of the putter. $C_{g,\ putter}$ and $C_{g,\ head}$ represent the centers of mass of a putter according to the present invention using a typical putter head respectively. Most conventional putter heads are designed with $C_{g,\ head}$ positioned so that it is aligned with the geometric midpoint of the face in the horizontal direction (i.e., on line 26, which bisects face 22). Such a conventional putter head can be effectively incorporated into a putter according to the present invention. If such a conventional putter head is incorporated into a putter according to the present invention, the resulting center of mass of the entire putter is positioned toward shaft 30 and upward, for example, to location $C_{g,\ putter}$. With this arrangement, no moment is induced when the ball strikes face 22 at a point on line 26 because there is no horizontal distance between line 26 and the point on face 22 at which the ball strikes face 22. However, a small, acceleration-induced moment will exist because of the horizontal distance, d', between $C_{g,\ putter}$ and line 26. It is possible, however, to design putter head 20 in a manner that eliminates both types of moments.

Putter head 20 may be designed such that the center of mass of head 20, $C'_{g,\ head}$, is on the opposite side of line 26 from the side on which shaft 30 is located in precisely that location that will cause the center of mass of the entire putter, $C'_{g,\ putter}$, to be located on line 26. This redistribution of mass in putter head 20 may also be done in such a manner that the geometric center of face 22 still lies on line 26. This design feature is important because of the natural tendency of a player to want to strike the ball with the center of the face of the putter. When a putter according to the present invention is designed to incorporate $C'_{g,\ putter}$ and $C'_{g,\ head}$, swinging the putter and striking a ball with the putter do not cause acceleration- or force-induced moments around line 26. Thus, the player may more easily develop the touch necessary to control the speed and direction of a putt.

While certain embodiments of the present invention have been described above, these descriptions are given for purposes of illustration and explanation. Variations, changes, modifications and departures from the devices and methods disclosed above may be adopted without departure from the scope or spirit of the present invention which, in sum, is a putter that, among other features, is configured such that it hangs in a balanced manner directly from the player's shoulder joint when used to stroke a putt with a modified croquet style putting stroke.

I claim:

1. A golf putter for use in a one-handed, modified croquet-style putting stroke, comprising:

a. a head defining a head center of mass and comprising a face defining a face angle line having a midpoint;

b. a shaft extending from the head to a free end and defining a shaft axis such that an angle of at least ten degrees is formed by:

i. a projection of the shaft axis onto a first plane that is vertical when the putter is in a normal address position and containing the face angle line and ii. a line also within the plane that is perpendicular to the face angle line; and c. a grip mounted on the free end of the shaft such that the grip is approximately bisected by a second plane that:

i. is perpendicular to the face angle line and ii. contains the midpoint of the face angle line.

2. The golf putter of claim 1 in which the shaft further comprises:

a. a connector portion having a first end connected to the head and a second end and b. a straight portion connected to the second end of the connector portion and in which the shaft axis is defined by the straight portion and the free end of the shaft is on the straight portion.

3. The golf putter of claim 2 in which:

a. the combination of the grip, head, and shaft define a putter center of mass; and b. the center of mass of the head is positioned so that the putter center of mass is located on the second plane.

4. The golf putter of claim 3 in which the grip further comprises a bore that is disposed at an angle from vertical when the putter is in a normal address position such that a longitudinal axis of the grip is substantially vertical.

5. The golf putter of claim 4 in which the grip further comprises a first flat land.

6. The golf putter of claim 5 in which the grip further comprises a second flat land.

7. The golf putter of claim 1 in which the grip further comprises a bore that is disposed at an angle from vertical when the putter is in a normal address position such that a longitudinal axis of the grip is substantially vertical.

8. The golf putter of claim 7 in which the grip further comprises a first flat land.

9. The golf putter of claim 8 in which the grip further comprises a second flat land.

10. The golf putter of claim 1 in which:

a. the combination of the grip, head, and shaft define a putter center of mass; and b. the center of mass of the head is positioned so that the putter center of mass is located on the second plane.

11. The golf putter of claim 10 in which the grip further comprises a bore that is disposed at an angle from vertical when the putter is in a normal address position such that a longitudinal axis of the grip is substantially vertical.

12. The golf putter of claim 11 in which the grip further comprises a first flat land.

13. A golf putter for use in a one-handed, modified croquet-style putting stroke. comprising:

a. a head defining a head center of mass and comprising a face defining a face angle line;

b. a shaft extending from the head, comprising:

i. connector portion having a first end connected to the head and a second end;

ii. a straight portion connected to the second end of the connector portion and extending to a free end; and iii. defining a shaft axis along the straight portion such that an angle of at least ten degrees is formed by:

A. a projection of the shaft axis onto a plane that is vertical when the putter is in a normal address position and containing the face angle line and B. a line also within the plane that is perpendicular to the face angle line;

c. a grip mounted on the free end such that when a player grasps the grip with one hand and addresses a golf ball, the head center of mass, the grip, and the player's shoulder lie along a substantially vertical line; and d. in which:

i. the combination of the grip, head, and shaft define a putter center of mass; and ii. the head center of mass is located so that the putter center of mass is located on a second plane that:

A. is perpendicular to the face angle and

B. contains the midpoint of the face angle line.

14. A golf putter, comprising:

A. a head defining a head center of mass and comprising a face defining a face angle line;

B. a shaft extending from the head to a free end and defining a shaft axis such that an angle of at least ten degrees is formed by:

i. a projection of the shaft axis onto a plane that is vertical when the putter is in a normal address position and containing the face angle line and ii. a line also within the plane that is perpendicular to the face angle line;

C. a grip mounted on the free end; and

D. in which:

i. the combination of the grip, head, and shaft defines a putter center of mass; and ii. the head center of mass is located so that the putter center of mass is located in a second plane that:

a. is perpendicular to the face angle line and b. contains the midpoint of the face angle line.

15. The golf putter of claim 14, in which the shaft further comprises:

A. a connector portion having a first end connected to the head and a second end and B. a straight portion connected to the second end of the connector portion and in which the shaft axis is defined by the straight portion and the free end of the shaft is on the straight portion.

16. The golf putter of claim 15, in which the grip further comprises a bore that is disposed at an angle from vertical when the putter is in a normal address position such that a longitudinal axis of the grip is substantially vertical.

17. The golf putter of claim 16, in which the grip further comprises a first flat land.

18. The golf putter of claim 17, in which the first flat land is substantially parallel to the plane.

19. The golf putter of claim 18, in which the grip further comprises a second flat land.

20. The golf putter of claim 19, in which the second flat land is substantially parallel to the plane.

21. The golf putter of claim 14, in which the grip further comprises a bore that is disposed at an angle from vertical when the putter is in a normal address position such that a longitudinal axis of the grip is substantially vertical.

22. The golf putter of claim 21, in which the grip further comprises a first flat land.

23. The golf putter of claim 22, in which the first flat land is substantially parallel to the plane.

24. The golf putter of claim 23, in which the grip further comprises a second flat land.

25. The golf putter of claim 24, in which the second flat land is substantially parallel to the plane.

26. A golf putter for use in a one-handed, modified croquet-style putting stroke, comprising:

A. a head defining a head center of mass and comprising a face defining a face angle line;

B. a shaft extending from the head to a free end and defining a shaft axis such that an angle of at least ten degrees is formed by:

i. a projection of the shaft axis onto a plane that is vertical when the putter is in a normal address position and containing the face angle line and ii. a line also within the plane that is perpendicular to the face angle line;

C. a grip mounted on the free end such that when a player grasps the grip with one hand and addresses a golf ball, the head center of mass, the grip, and the player's shoulder lie along a substantially vertical line; and D. in which:

i. the combination of the grip, head, and shaft define a putter center of mass; and ii. the head center of mass is located so that the putter center of mass is located in a second plane that:

a. is perpendicular to the face angle line and b. contains the midpoint of the face angle line.

* * * * *